US006680561B2

(12) United States Patent
Yamaguchi et al.

(10) Patent No.: US 6,680,561 B2
(45) Date of Patent: Jan. 20, 2004

(54) SPARK PLUG

(75) Inventors: Makoto Yamaguchi, Aichi (JP); Tsutomu Shibata, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/283,113

(22) Filed: Oct. 30, 2002

(65) Prior Publication Data

US 2003/0117052 A1 Jun. 26, 2003

(30) Foreign Application Priority Data

Oct. 31, 2001 (JP) ..... 2001-335110

(51) Int. Cl.[7] ..... H01T 13/20; H01T 13/00
(52) U.S. Cl. ..... 313/118; 313/136
(58) Field of Search ..... 313/136, 118, 313/141, 142; 123/169 EL

(56) References Cited

FOREIGN PATENT DOCUMENTS

| | | |
|---|---|---|
| JP | 4-47691 | 2/1992 |
| JP | 4-133283 | 5/1992 |
| JP | P3099240 | 8/2000 |
| JP | 2001-185324 | 7/2001 |

*Primary Examiner*—Nimeshkumar Patel
*Assistant Examiner*—Glenn Zimmerman
(74) *Attorney, Agent, or Firm*—Sughrue Mion, PLLC

(57) ABSTRACT

A spark plug includes: a metal shell defining a front side having an outer periphery formed with a screw section which has a nominal size smaller than or equal to M12; a center electrode; a conductive seal layer; a terminal metal fitting fixed to the center electrode via the conductive seal layer; and an insulator formed with a through hole. The terminal metal fitting has a Vickers hardness in a range from 150–300 Hv. The terminal metal fitting includes: a front end section having an outer diameter, and embedded in the conductive seal layer, and a small diameter section disposed on a rear side of the front end section and having an outer diameter which is smaller than the outer diameter of the front end section. The through hole has an inner diameter different from the outer diameter of the small diameter section in a range from 1.0–1.4 mm.

20 Claims, 3 Drawing Sheets

SPARK PLUG

BACKGROUND OF THE INVENTION

1. Field of the Invention

The present invention relates to a spark plug used for an internal combustion engine. More specifically, the present invention relates to the spark plug having a screw diameter smaller than or equal to 12 mm (i.e., 10 mm or 12 mm).

2. Description of the Related Art

The present invention relates to a spark plug for an internal combustion engine. Especially, the present invention relates to the spark plug having a screw diameter smaller than or equal to 12 mm (for example, 10 mm, 12 mm and the like).

Conventionally, a spark plug having the following construction is well known:

A through hole having a first end side and a second end side (opposite to the first end side) is formed in a direction of an axial line of an insulator. A center electrode is inserted for fixation into the first end side of the through hole, while a terminal metal fitting is inserted for fixation into the second end side of the through hole. In the through hole, a resistor is interposed between the center electrode and the terminal metal fitting.

The resistor is made of a glass mixed with a conductive material (such as carbon black, metal and the like), where blending (proportion) of the metal is not considerably high. Thus, joining the resistor directly to the metals {that is, the center electrode and the terminal metal fitting} is very often of difficulty. Therefore, a conductive glass seal layer which is made of a mixture of metal (in plenty) and glass is conventionally interposed between the resistor and the center electrode, and between the resistor and the terminal metal fitting, for improving joint strength.

The conventional spark plug comprising the above resistor is manufactured in the following steps:

1) Insert the center electrode into the through hole of the insulator, for fixation.
2) Fill the through hole with conductive glass powder.
3) Fill raw material powder of a composition of the resistor.
4) Furthermore, fill the through hole with the conductive glass powder.
5) Then, insert the terminal metal fitting into the through hole, to thereby make an assembly.

As a result, the through hole of the insulator is allowed to have the following inner construction in a form of an accumulation sequentially from the center electrode's side:

a) a first conductive glass powder layer,
b) a powder layer of the composition of the resistor, and
c) a second conductive glass powder layer.

In the thus obtained state, the assembly is conveyed to a heating furnace and heated at a glass softening point or over. Thereafter, the terminal metal fitting is pushed (press fitted) from a side opposite to the center electrode's side into the through hole in the direction of the axial line, to thereby compress the first conductive glass powder layer, the powder layer of the composition of the resistor, and the second conductive glass powder layer.

The above compression forms, respectively, a first conductive glass seal layer {on the center electrode's side}, the resistor, and a second conductive glass seal layer {on the terminal metal fitting' side}. In other words, this construction allows the center electrode and the terminal metal fitting to join to the resistor, respectively, by way of the first conductive glass seal layer and the second conductive glass seal layer. The assembly having the thus obtained insulator, the center electrode and the terminal metal fitting is received for fixation in a metal shell which is shaped substantially into a tube.

Recently, preference for a smaller spark plug is likely to increase. To meet this preference, the spark plug is earnestly preferred to have its screw section's diameter smaller than or equal to 12 mm (such as M12, M10 and the like under ISO 2705, where ISO stands for International Standardization Organization). The small spark plug, however, has such a restriction that the material used for the terminal metal fitting is limited due to difficulty of the above glass sealing steps. With this, the small spark plug cannot feature as high quality as a large spark plug {for example, a spark plug having its screw section's diameter larger than or equal to 14 mm} can.

In the above glass sealing steps, the maximum heating temperature is generally about 900° C. For the following cause, it is preferable to use the terminal metal fitting made of a steel product that is unlikely to get softened in the above heating temperature of about 900° C.:

When the spark plug having the terminal metal fitting that is insufficient in hardness is mounted to the internal combustion engine, the terminal metal fitting may cause a wear due to a friction with a mouth piece of a plug cap. The thus caused wear may lead to failures such as flash over (attributable to wear powder), increased contact resistance (between the terminal section and the mouth piece of the plug cap), and the like.

For the terminal metal fitting, the spark plug having the large screw section's diameter can use the steel product that is unlikely to get softened in the glass sealing step. However, such steel product (as is) cannot necessarily be used for the terminal metal fitting of the spark plug having the small screw section's diameter.

More specifically, using the hard steel product for the terminal metal fitting of the spark plug having the small screw section's diameter is, as the case may be, responsible for possible cracks which may be caused to the insulator in the glass sealing step.

The insulator itself of the spark plug having the small screw section's diameter is thin. Such spark plug is, as a matter of course, low in strength. Using the hard steel product for the terminal metal fitting of the spark plug having the small screw section's diameter cannot relax an excessive stress attributable to a deflection {of the terminal metal fitting} which may be caused when the terminal metal fitting is press fitted into the insulator. As a result, the excessive stress (beyond upper limit) is applied to the insulator.

On the other hand, the terminal metal fitting that is too diminished in size (diameter) for relaxing the stress applied to the insulator may cause insufficient glass sealing, resulting in failures such as low joint strength, increased contact resistance and the like.

The above description concerning the spark plug having the small screw section's diameter ends up as what is called a dilemma.

BRIEF SUMMARY OF THE INVENTION

It is an object of the present invention to provide a spark plug which is unlikely to cause wear to a terminal metal fitting, and which has an insulator, the terminal metal fitting and a center electrode that are connected securely. Especially, the present invention relates to the spark plug having a screw section diameter smaller than or equal to 12 mm.

More specifically, the spark plug of the present invention has the screw nominated by M12 (screw diameter 12 mm) and M10 (screw diameter 10 mm) under ISO 2705, where ISO stands for International Standardization Organization. Fluctuation in dimension is allowed within a range specified by the ISO 2705.

According to a first aspect of the present invention, there is provided a spark plug, comprising: a metal shell defining a front side having an outer periphery formed with a screw section which has a nominal size smaller than or equal to M12; a center electrode; a conductive seal layer; a terminal metal fitting fixed to the center electrode by way of the conductive seal layer; and an insulator formed with a through hole which extends in a direction of an axial line of the insulator and houses the center electrode, the conductive seal layer and the terminal metal fitting. The terminal metal fitting has a Vickers hardness in a range from 150 Hv to 300 Hv. The terminal metal fitting includes: a front end section having an outer diameter, and embedded in the conductive seal layer, and a small diameter section disposed on a rear side of the front end section and having an outer diameter which is smaller than the outer diameter of the front end section. The insulator has an outer periphery where the metal shell is disposed. The insulator defines the following sides in the direction of the axial line of the insulator: i) a front side where the center electrode is disposed, and ii) a rear side where the terminal metal fitting is disposed. The through hole has an inner diameter which is different from the outer diameter of the small diameter section of the terminal metal fitting in a range from 1.0 mm to 1.4 mm.

According to a second aspect of the present invention, there is provided a spark plug, comprising: a metal shell; a center electrode; a conductive seal layer; a terminal metal fitting fixed to the center electrode by way of the conductive seal layer; and an insulator formed with a through hole which extends in a direction of an axial line of the insulator and houses the center electrode, the conductive seal layer and the terminal metal fitting. The terminal metal fitting includes: a front end section having an outer diameter, and embedded in the conductive seal layer, and a small diameter section disposed on a rear side of the front end section and having an outer diameter which is smaller than the outer diameter of the front end section in a range from 0.3 mm to 0.7 mm. The small diameter section defining a front side which is partly embedded in the conductive seal layer. The insulator has an outer periphery where the metal shell is disposed. The insulator defines the following sides in the direction of the axial line of the insulator: i) a front side where the center electrode is disposed, and ii) a rear side where the terminal metal fitting is disposed.

The terminal metal fitting according to the first aspect and the second aspect of the present invention can keep the Vickers hardness in the range from 150 Hv to 300 Hv even after glass sealing steps. Thereby, even when engine vibration may cause a friction between a mouth piece {of a plug cap} and a terminal section {of the terminal metal fitting}, the terminal section is unlikely to get worn. Therefore, conductivity can be secured for a long time, thus making the spark plug highly reliable.

The Vickers hardness lower than 150 Hv may not bring about high wear resistance. Therefore, using the spark plug for a long time may cause the wear, thus leading to failures such as increased contact resistance {between the terminal section and the mouth piece of the plug cap}, flash over attributable to wear powder, and the like.

On the other hand, the Vickers hardness higher than 300 Hv may extremely limit material usable for the terminal metal fitting. Moreover, in this case, too high a hardness (or rigidity) of the terminal metal fitting may be responsible for the following failures:

When the engine vibration and the like may apply a stress to the terminal metal fitting, the thus applied stress cannot be dispersed effectively, resulting in concentration of the stress in a specific section of an insulator. The thus concentrated stress may break the insulator.

Herein, the Vickers hardness of the terminal metal fitting is defined as a value measured in the terminal section projecting rearward from the insulator.

The spark plug has the construction in which the outer diameter {of the small diameter section} and the inner diameter {of the through hole of the insulator} is in the range from 1.0 mm to 1.4 mm, thus making the spark plug small in screw section.

Generally, manufacturing the spark plug having the above construction uses the glass sealing steps.

In the glass sealing steps, the insulator is heated, while the terminal metal fitting is press fitted into the through hole of the insulator so as to compress a conductive glass powder layer and the like accumulated in the through hole. Press fitting the terminal metal fitting is carried out by means of a special equipment at a predetermined stroke. The terminal metal fitting featuring a "proper softness" may elastically deform or plastically deform, thereby relaxing excessive stress which may be applied to the conductive glass powder layer and the insulator. On the contrary, allowing the terminal section to have the Viekers hardness of 150 Hv or over renders entire part of the terminal metal fitting to have the Vickers hardness of 150 Hv or over, which is not flexible.

Therefore, the small diameter section {of the terminal metal fitting} is so adjusted to have the outer diameter that is different from the inner diameter {of the through hole of the insulator} in the range from 1.0 mm to 1.4 mm. The thus adjusted difference can contribute to relaxation of the stress, by allowing the terminal metal fitting (even if high in hardness) to properly deflect toward the small diameter section.

The difference smaller than 1.0 mm cannot secure enough space for the terminal metal fitting to deflect in the glass sealing steps, thus failing to relax the excessive stress.

On the contrary, the difference larger than 1.4 mm may be responsible for an excessive space between the insulator and the terminal metal fitting, allowing the terminal metal fitting to excessively deflect toward the small diameter section, resulting in an insufficient joint strength in the glass sealing steps due to short pressure. Herein, the joint strength is a strength for joining the insulator and the terminal metal fitting.

Especially, the spark plug with the screw section smaller than or equal to 12 mm (M12) has a difficulty in increasing thickness of the insulator for improving strength of the insulator. Therefore, preventing cracks which may be caused in the glass sealing steps may be achieved by modification of the terminal metal fitting.

In sum, the spark plug according to the first aspect and the second aspect of the present invention can eliminate need for redesigning the insulator and secure glass sealing steps. Moreover, the spark plug according to the first aspect and the second aspect of the present invention can render the terminal metal fitting to securely join with the center electrode by way of the conductive seal material, contributing to failure-free (failures such as increased contact resistance) and small size {of the spark plug}.

The other objects and features of the present invention will become understood from the following description with reference to the accompanying drawings.

DETAILED DESCRIPTION OF THE EMBODIMENT

In the following, various embodiments of the present invention will be described in detail with reference to the accompanying drawings.

For ease of understanding, the following description will contain various directional terms, such as, left, right, upper, lower and the like. However, such terms are to be understood with respect to only a drawing or drawings on which the corresponding part of element is illustrated.

Figure 1:
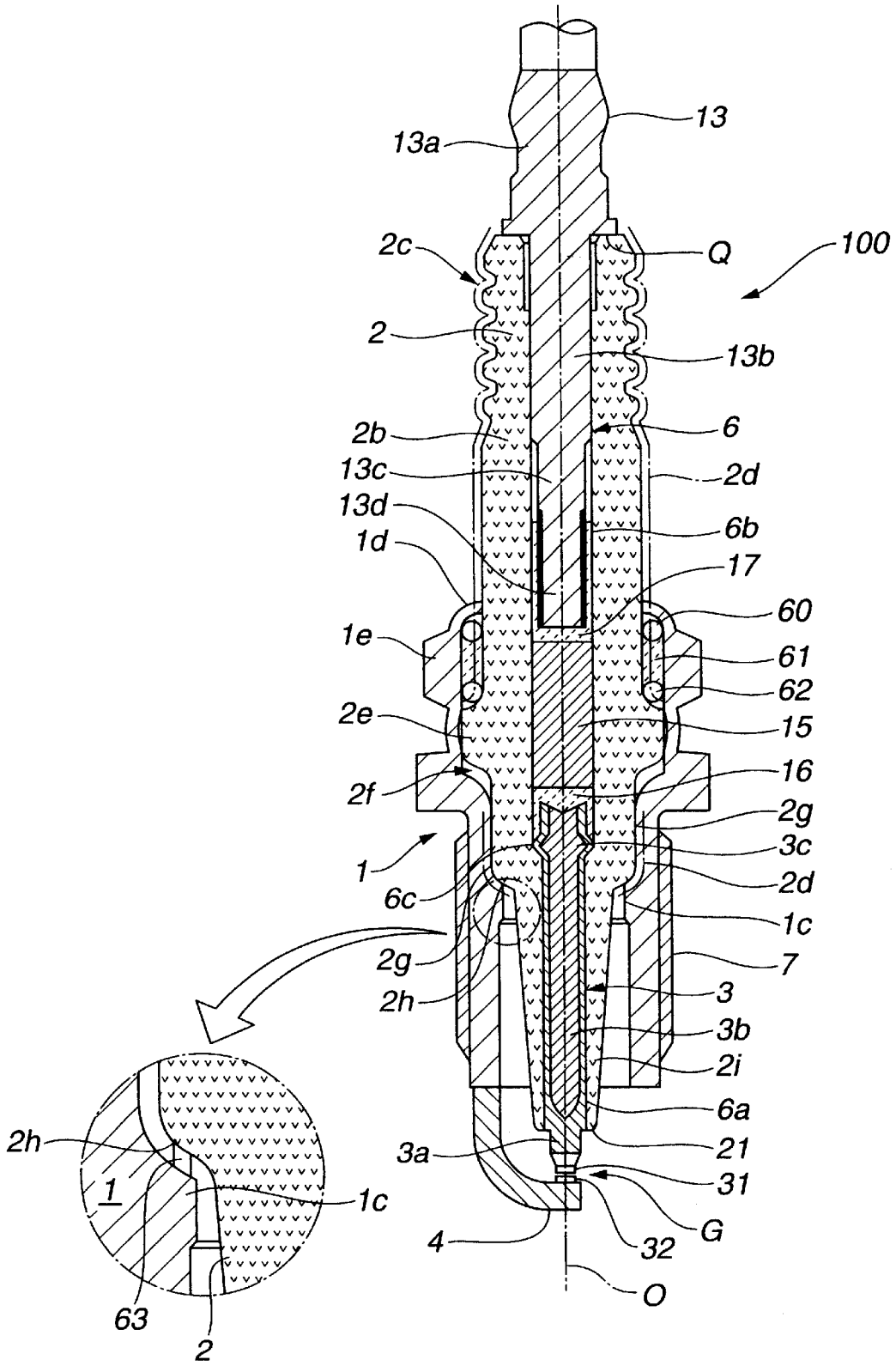
FIG. 1 is a longitudinal cross section of an overall view of a spark plug 100, according to an embodiment of the present invention.

As is seen in FIG. 1, there is provided a spark plug 100 according to an embodiment of the present invention.

The spark plug 100 is constituted of a metal shell 1, an insulator 2, a center electrode 3 and a ground electrode 4 and the like. The metal shell 1 is tubular. The insulator 2 mates in the metal shell 1, and has a head end section 21 protruding (downward in FIG. 1) from the metal shell 1. The center electrode 3 mates in the insulator 2 in such a manner that a first igniter 31 is disposed at a head end (lower in FIG. 1) of the center electrode 3 and protrudes from the insulator 2. The ground electrode 4 has a first end (upper in FIG. 1) coupled to the metal shell 1 by welding and the like, and a second end (lower in FIG. 1) bent sideward (rightward in FIG. 1). The second end of the ground electrode 4 has a side face opposing the head end of the center electrode 3.

The ground electrode 4 is formed with a second igniter 32 which is so opposed to the first igniter 31 as to form a spark discharge gap G therebetween. The ground electrode 4 and a body section 3*a* (of the center electrode 3) are made of nickel alloy and the like. In the body section 3*a* of the center electrode 3, a core material 3*b* made of Cu, Cu alloy or the like is embedded for encouraging heat radiation.

The metal shell 1 is made of a metal such as low carbon steel, and is shaped substantially into a cylinder. The metal shell 1 constitutes a housing of the spark plug 100. Moreover, the metal shell 1 has an outer periphery which is formed with a screw section 7 used for mounting the spark plug 100 to an engine block (not shown in FIG. 1). Moreover, the metal shell 1 is formed with a tool engagement section 1*e* engaging with a tool such as a spanner, a wrench and the like which are used for mounting the metal shell 1 to the spark plug 100. The tool engagement section 1*e* has a cross section (when viewed in a direction along an axial line O of the insulator 2) which is shaped substantially into a hexagon.

An entire construction of the insulator 2 is a sintered body made of an alumina ceramic. The insulator 2 is formed with a through hole 6 extending in a direction along the axial line O. The insulator 2 has a first end (lower in FIG. 1) to which the center electrode 3 is fixed, and a second end (upper in FIG. 1) to which a terminal metal fitting 13 is fixed. In the through hole 6 of the insulator 2, there is provided a resistor 15 which is interposed between the center electrode 3 and the terminal metal fitting 13. The resistor 15 has a first end (lower in FIG. 1) which is electrically connected to the center electrode 3 by way of a first conductive glass seal layer 16, and a second end (upper in FIG. 1) which is electrically connected to the terminal metal fitting 13 by way of a second conductive glass seal layer 17. The resistor 15, the first conductive glass seal layer 16 and the second conductive glass seal layer 17 constitute a sintered conductive material. Hereinabove, the resistor 15 is made of a resistor composition which uses a mixed powder as a raw material, wherein the mixed powder includes a glass powder and a conductive material powder (and if necessary, a ceramic powder other than the glass).

With respect to the axial line O of the insulator 2, a front side is defined as a side having the center electrode 3 (lower in FIG. 1), while a rear side is defined as a side having the terminal metal fitting 13 (upper in FIG. 1).

In the longitudinal center of the axial line O of the insulator 2, there is formed a protrusion section 2*e* protruding outward circumferentially in a form of a flange. The insulator 2 has a body section 2*b* which is disposed on the rear side of the protrusion section 2*e*. The body section 2*b* is smaller in diameter than the protrusion section 2*e*.

On the other hand, the insulator 2 has a first shaft section 2*g* on the front side of the protrusion section 2*e*. The first shaft section 2*g* is smaller in diameter than the protrusion section 2*e*. There is formed a second shaft section 2*i* on the front side of the first shaft section 2*g*. The second shaft section 2*i* is smaller in diameter than the first shaft section 2*g*. There is formed a corrugation section 2*c* on the rear side of an outer periphery of the body section 2*b*. The corrugation section 2*c* has an outer periphery which is formed with a glaze layer 2*d*. An outer periphery of the first shaft section 2*g* is shaped substantially into a cylinder. An outer periphery of the second shaft section 2*i* is shaped substantially into a cone which is more reduced in diameter toward the head end section 21 of the insulator 2.

The through hole 6 of the insulator 2 has a first section 6*a* and a second section 6*b*. The first section 6*a* into which the center electrode 3 is inserted is shaped substantially into a cylinder. The second section 6*b* which is also shaped substantially into a cylinder is disposed on the rear side (upper in FIG. 1) of the first section 6*a*, and is larger in diameter than the first section 6*a*. The terminal metal fitting 13 and the resistor 15 are housed in the second section 6*b*, while the center electrode 3 is inserted into the first section 6*a*. On the rear side of the center electrode 3, there is formed a convex section 3*c* which protrudes outward from an outer periphery of the center electrode 3 in such a manner as to fix the center electrode 3. The first section 6*a* and the second section 6*b* of the through hole 6 are connected with each other in the first shaft section 2*g*. The thus connected position is formed with a receptacle face 6*c* for receiving the convex section 3*c* of the center electrode 3. The receptacle face 6*c* is shaped substantially into a taper or a roundness.

A connector section 2*h* connecting the first shaft section 2*g* and the second section shaft section 2*i* defines an outer periphery which is shaped substantially into a step, as is seen in a partly enlarged view of FIG. 1. By way of a plate packing 63 shaped substantially into a ring, the connector section 2*h* may engage with a convex section 1*c* formed on an inner periphery of the metal shell 1, to thereby prevent removal of the insulator 2 from the metal shell 1 in the direction of the axial line O.

On the other hand, there is provided a second line packing 62 between the outer periphery of the insulator 2 and an inner periphery of a space defined on the rear side of the metal shell 1. The second line packing 62 shaped substantially into a ring may engage with the rear side of the protrusion section 2*e* shaped substantially into the flange. On the further rear side of the metal shell 1, there is provided a first line packing 60 in such a manner that the second line packing 62 and the first line packing 60 interpose therebetween a packed bed 61 which is made of talc and the like.

The metal shell 1 can be fixed to the insulator 2 in the following steps:

1) Press the insulator 2 into the metal shell 1 frontward (lower in FIG. 1).
2) Caulk an opening end of the metal shell 1 inward to the first line packing 60, to thereby form a caulked section 1*d*.

Figure 2:
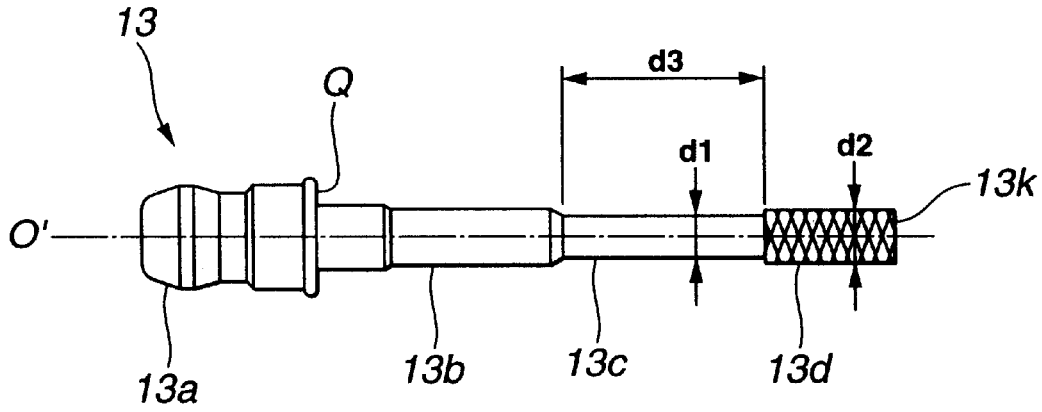
FIG. 2 is an overall view of a terminal metal fitting 13.

FIG. 2 shows a general view of the terminal metal fitting 13.

The terminal metal fitting 13 is, as a whole, shaped substantially into a round rod. The terminal metal fitting 13 defines an axial line O' which is substantially consistent with the axial line O (see FIG. 1) of the insulator 2. Moreover, the terminal metal fitting 13 is constituted of a terminal section 13*a*, a large diameter section 13*b*, a small diameter section 13*c*, and a front end section 13*d*. The terminal section 13*a* is shaped substantially into a barrel, and so engages with a mouth piece of a plug cap (not shown in FIG. 1 or FIG. 2) as to secure electric conductivity. The large diameter section 13*b* is disposed in the through hole 6 of the insulator 2, and extends from the terminal section 13*a* toward a head end of the terminal metal fitting 13. The large diameter section 13*b* defines a front end which is reduced in diameter. The small diameter section 13*c* extends frontward from the above front end (reduced in diameter) of the large diameter section 13*b*. The front end section 13*d* is slightly larger in diameter than the small diameter section 13*c*, and has an outer periphery which is machined through a knurling.

According to the embodiment of the present invention, the terminal section 13*a* is, what is called, a united part of the terminal metal fitting 13. The same can hold true for a spark plug having a screw type terminal section 13*a* (namely, removable terminal section 13*a*).

As is seen in FIG. 1, the front end section 13*d* of the terminal metal fitting 13 is a section that is embedded in the second conductive glass seal layer 17. The small diameter section 13*c* is so formed as to extend rearward from the front end section 13*d*. The small diameter section 13*c* has a front side (right in FIG. 2) which is partly embedded in the second conductive glass seal layer 17, like the front end section 13*d*. The terminal section 13*a* has a front side defining a seal face Q which abuts on a rear end face of the insulator 2. The seal face Q is so formed as to as to surround the axial line O'.

Setting up a difference between an outer diameter d1 (of the small diameter section 13*c*) and an outer diameter d2 (of the front end section 13*d*) in a range from 0.3 mm to 0.7 mm allows the second conductive glass seal layer 17 to be formed in such a manner as to wrap the front end section 13*d*. With this, joint strength (between the insulator 2 and the terminal metal fitting 13) can be increased, and the outer diameter d1 of the small diameter section 13*c* can be prevented from becoming too small.

Used for the terminal metal fitting 13 includes an alloy steel SCM435 that is specified by JIS-G4025, where JIS stands for Japanese Industrial Standard. The alloy steel SCM435 can be prevented from becoming soft in a heating temperature range (for example, max. 930° C. to max. 950° C.) which is caused in a glass sealing step. Moreover, the above alloy steel SCM435 can be hardened without rapid quenching.

Japanese Patent Unexamined Publication No. Heisei 4(1922)-133283 {equivalent of Japanese Patent Examined Publication No. P3099240} and Japanese Patent Unexamined Publication No. P2001-185324A disclose technologies usable for making the terminal metal fitting 13.

When the terminal metal fitting 13 is press fitted into the insulator 2 in the glass sealing step, mainly the small diameter section 13*c* and the front end section 13*d* are deflected in such a manner as to curve the axial line O', to thereby prevent a pressure (which is applied from a press fitting device) from concentrating on a head end face 13*k* (see FIG. 2) of the front end section 13*d*. The above operation can help prevent cracks which may be caused, by way of the resistor 15, the first conductive glass seal layer 16 and the second conductive glass seal layer 17, in the vicinity of a boundary between the first shaft section 2*g* and the second shaft section 2*i*. More specifically, the outer diameter d1 of the small diameter section 13*c* preferably has a difference in a range from 1.0 mm to 1.4 mm from an inner diameter D6 (see FIG. 4) of the second section 6*b* of the through hole 6 of the insulator 2. The above difference (in the range from 1.0 mm to 1.4) allows the terminal metal fitting 13 to have proper deflection even with Vickers hardness kept in a range from 150 Hv to 300 Hv.

Figure 3:
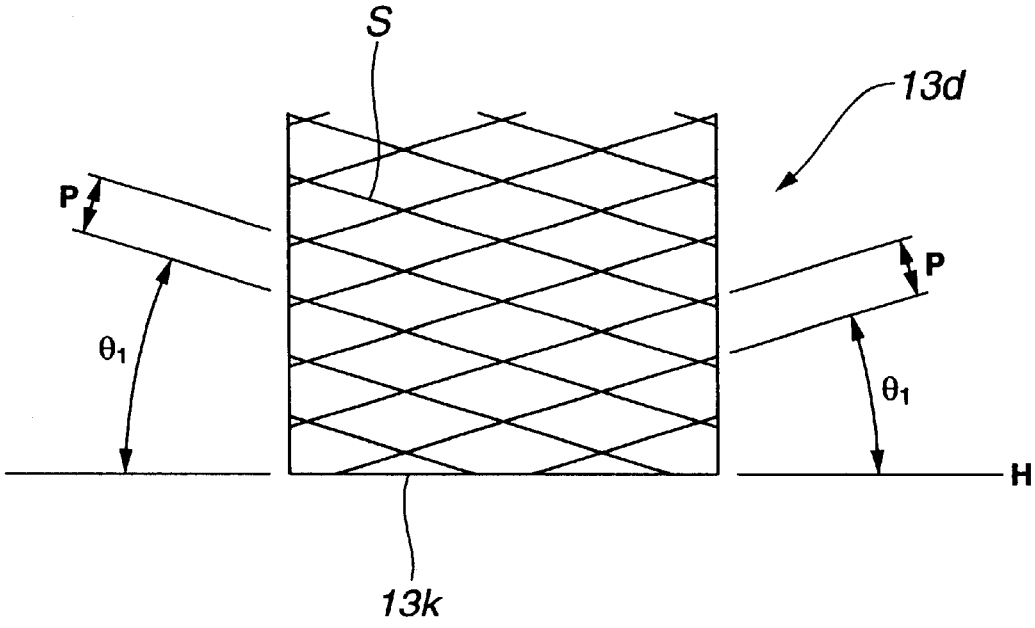
FIG. 3 is a schematic of a knurled slot S which is formed in a front end section 13*d* of the terminal metal fitting 13.

The knurling of the front end section 13*d* is carried out in the following steps:

1) Prepare a straight rod featuring no difference in diameter between the front end section 13*d* and the small diameter section 13*c*, and featuring difference in diameter between the terminal section 13*a* and the large diameter section 13*b*.
2) Use a die for knurling (rolling) a head end of the straight rod, to thereby form knurled slots S each of which defining a predetermined angle θ1, as is seen in FIG. 3.

The adjacent two knurled slots S define a knurled slot distance P. After the knurling, a section covering the front end section 13*d* causes such a plastic deformation as to change (increase) the diameter of the front end section 13*d*.

The straight rod as described above can be replaced otherwise. More specifically, another rod can secure in advance a proper difference in diameter between the small diameter section 13*c* and the front end section 13*d*.

The plural knurled slots S thus formed through the knurling are in parallel with each other. The predetermined angle θ1 defined by the knurled slot S as is seen in FIG. 3 is preferably in a range from 15° to 25° relative to a reference line H which is perpendicular to the axial line O'.

The predetermined angle θ1 smaller than 15° is not preferred for the following cause:

When the terminal metal fitting 13 is embedded in the second conductive glass seal layer 17, a glass seal material is less likely to rise toward the rear side of the terminal metal fitting 13. This may also cause shortage of filling the glass seal material in each of the knurled slots S.

Conductive glass powders having mean diameter ⅙ to ⅓ as large as the knurled slot distance P is preferred for sufficiently filling the glass seal material in each of the knurled slots S. Forming the second conductive glass seal layer 17 using the above conductive glass powders (having mean diameter ⅙ to ⅓ as large as the knurled slot distance P) can increase the joint strength between the insulator 2 and the terminal metal fitting 13.

On the other hand, the predetermined angle θ1 larger than 25° is not preferred for the following cause:

The pressure applied to the second conductive glass seal layer 17 when press fitting the terminal metal fitting 13 into the insulator 2 may become insufficient. The thus applied small pressure may render the glass sealing insufficient, thereby decreasing the joint strength between the insulator 2 and the terminal metal fitting 13.

Other than the knurling described above, a surface roughing can be adopted for machining the front end section 13*d* of the terminal metal fitting 13.

Figure 4:
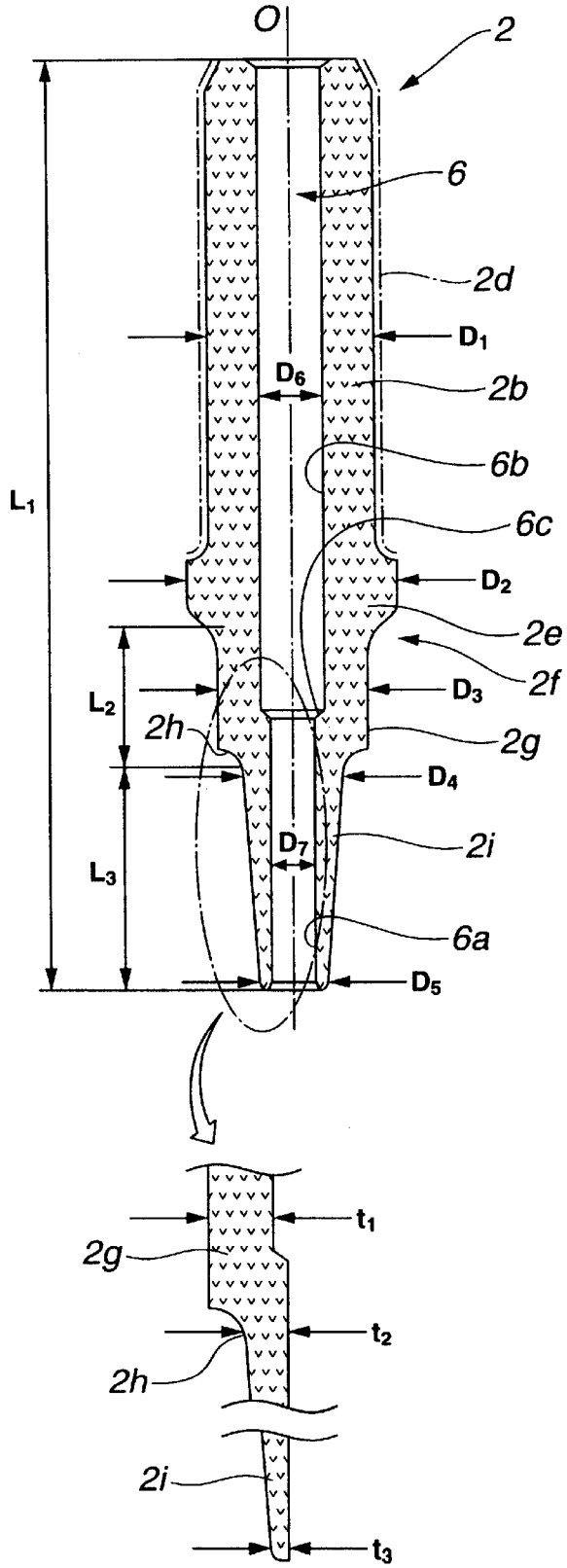
FIG. 4 is a longitudinal cross section of an insulator 2 with dimensions, and a partly enlarged view of the insulator 2.

FIG. 4 shows the insulator 2 exemplifying dimensions as follows:

| | |
|---|---|
| 1) Overall length L1: | 30 mm to 75 mm. |
| 2) Length L2 of first shaft section 2g: | 0 mm to 30 mm. |
| * Connector section 2f (between protrusion section 2e and first shaft section 2g) not included. | |
| ** Connector section 2h (between second shaft section 2i and first shaft section 2g) included. | |
| 3) Length L3 of second shaft section 2i: | 2 mm to 27 mm. |
| 4) Outer diameter D1 of body section 2b: | 9 mm to 13 mm. |
| 5) Outer diameter D2 of protrusion section 2e: | 11 mm to 16 mm. |
| 6) Outer diameter D3 of first shaft section 2g: | 5 mm to 11 mm. |
| 7) Outer diameter D4 of bottom end section of second shaft section 2i: | 3 mm to 8 mm. |
| 8) Outer diameter D5 of head end section of second shaft section 2i: | 2.5 mm to 7 mm. |
| * When an outer periphery of the head end face of the second shaft section 2i is rounded or chamfered, the outer diameter D5 is defined as an outer diameter in a bottom end position of the roundness or the chamfer and defined in a cross section including the axial line O. | |
| 9) Inner diameter D6 of second section 6b of through hole 6: | 2 mm to 4 mm. |
| * The first conductive glass seal layer 16 and the second conductive glass seal layer 17 are formed in a range defined by the inner diameter D6. | |
| 10) Inner diameter D7 of first section 6a of through hole 6: | 1 mm to 3.5 mm. |
| 11) Thickness t1 of first shaft section 2g: | 0.5 mm to 4.5 mm. |
| 12) Thickness t2 of bottom end section of second shaft section 2i: | 0.3 mm to 3.5 mm. |
| * Measured in a direction perpendicular to the axial line O. | |
| 13) Thickness t3 of head end section of second shaft section 2i: | 0.2 mm to 3 mm. |
| * Measured in a direction perpendicular to the axial line O. | |
| ** When the outer periphery of the head end face of the second shaft section 2i is rounded or chamfered, the thickness t3 is defined as a thickness in the bottom end position of the roundness or the chamfer and defined in the cross section including the axial line O. | |
| 14) Arithmetic mean thickness tA {= (t2 + t3)/2} of second shaft section 2i: | 0.25 mm to 3.25 mm. |

The insulator 2 for the spark plug 100 (M12) under the present invention may have the following dimensions:

[Dimensions of Insulator 2]

| | | |
|---|---|---|
| 1) | Overall length L1: | about 60 mm. |
| 2) | Length L2: | about 10 mm. |
| 3) | Length L3: | about 14 mm. |
| 4) | Outer diameter D1: | about 11 mm. |
| 5) | Outer diameter D2: | about 13 mm. |
| 6) | Outer diameter D3: | about 7.3 mm. |
| 7) | Outer diameter D4: | 5.3 mm. |
| 8) | Outer diameter D5: | 4.3 mm. |
| 9) | Inner diameter D6: | 3.9 mm. |
| 10) | Inner diameter D7: | 2.6 mm. |
| 11) | Thickness t1: | 1.7 mm. |
| 12) | Thickness t2: | 1.4 mm. |
| 13) | Thickness t3: | 0.9 mm. |
| 14) | Arithmetic mean thickness tA: | 1.15 mm. |

Dimensions of the terminal metal fitting 13 are preferably adjusted in accordance with the above dimensions of the insulator 2 for the spark plug 100 (M12). More specifically, described as follows:

| | |
|---|---|
| 1) Distance d3 of small diameter section 13c in the direction of axial line O': | 4 mm to 25 mm. |
| 2) Outer diameter d1 of small diameter section 13c: | 2.5 mm to 3.2 mm. |

Moreover, difference between the inner diameter D6 (of the second section 6*b* of the through hole 6 of the insulator 2) and the outer diameter d2 (of the front end section 13*d*) is preferably in a range from 0.3 mm to 0.8 mm. The above difference can be defined as a gap between the inner diameter D6 and the outer diameter d2.

When the difference between the inner diameter D6 and the outer diameter d2 is too small (namely, smaller than 0.3 mm), the glass seal material of the second conductive glass seal layer 17 is unlikely to rise, resulting in an excessive stress applied to the insulator 2. On the contrary, when the difference between the inner diameter D6 and the outer diameter d2 is too large (namely, larger than 0.8 mm), the pressure cannot be applied to the insulator 2 sufficiently, to thereby fail to make the glass sealing strong. The outer diameter d2 of the front end section 13*d* is knurled as described above, and is defined as a vertical distance between a "line" including a crest and "another line" including an opposing crest of a thread of a normal screw (Hereinabove, the "line" and the "another line" are in parallel with a center axis of the normal screw).

Each of the first conductive glass seal layer 16 and the second conductive glass seal layer 17 includes a base glass, a conductive filler and an insulative filler. The base glass is mainly made of an oxide such as borosilicate. The conductive filler is mainly made of one kind of metal powder or two and more kinds of metal powders, selected from a group consisting of Cu, Fe and the like. The insulative filler can be one kind of oxide inorganic material or two and more kinds of oxide inorganic materials, selected from a group consisting of β-eucryptite, β-spodumene, keathite, silica, mullite, cordierite, zircon and aluminum titanate, and the like.

Mounting the center electrode 3 and the terminal metal fitting 13 to the insulator 2, and forming the resistor 15, the first conductive glass seal layer 16 and the second conductive glass seal layer 17 are carried out in the glass sealing step described below:

1) Spray (apply) a glaze slurry from a spray nozzle to a required surface of the insulator 2, so as to form a glaze slurry layer for forming the glaze layer 2*d*.

2) Dry the glaze slurry layer.

3) Insert the center electrode 3 into the first section 6*a* of the through hole 6 of the insulator 2.

4) Fill the first section 6*a* (of the through hole 6 of the insulator 2) with the conductive glass powder.

5) Preliminarily compress the thus filled conductive glass powder by inserting a presser bar (of a special equipment) into the through hole 6, to thereby form the first conductive glass seal layer 16.

6) Fill raw material powder of the composition of the resistor 15 from the rear side (upper in FIG. 1) of the insulator 2.

7) Preliminarily compress the thus filled raw material powder of the composition of the resistor 15, by using the presser bar.

8) Fill the conductive glass powder from the rear side of the insulator 2 from the rear side (upper in FIG. 1) of the insulator 2.

9) Preliminarily compress the thus filled conductive glass powder, by using the presser bar.

In sum, a first conductive glass powder layer (for the first conductive glass seal layer 16), a composition powder layer (for the resistor 15) and a second conductive glass powder layer (for the second conductive glass seal layer 17) can be formed in such a manner as to be accumulated from the center electrode 3's side (lower in FIG. 1) in the through hole 6.

Thereafter, an assembly is formed in such a state that the terminal metal fitting 13 is disposed on the rear side of the through hole 6. The thus formed assembly is inserted into a heating furnace, and thereby heated at a predetermined temperature of 700° C. to 950° C. Thereafter, the terminal metal fitting 13 is press fitted into the through hole 6 from the side opposite to the center electrode 3's side in the direction of the axial line O, to thereby compress the accumulated layers {namely, the first conductive glass powder layer (for the first conductive glass seal layer 16), the composition powder layer (for the resistor 15) and the second conductive glass powder layer (for the second conductive glass seal layer 17)} in the direction of the axial line O. Thereby, each of the accumulated layers can be compressed and sintered, to thereby form, respectively, the first conductive glass seal layer 16, the resistor 15 and the second conductive glass seal layer 17. The above wraps up the glass sealing step.

For the above glass sealing step, blending (proportion) and grain diameter of each of the base glass powder, the metal powder (conductive filler powder), and the insulative filler powder are preferably so adjusted as to allow the conductive glass powder to have an apparent softening (deformation) point in a range from 500° C. to 1000° C. When the softening point is lower than 500° C., the first conductive glass seal layer 16 and the second conductive glass seal layer 17 may feature insufficient heat resistance; while the softening point higher than 1000° C. may be responsible for decrease in sealing performance. Herein, the softening point can be determined in the following steps:

1) Prepare a sample (of the conductive glass powder) 50 mg.

2) Heat the sample for a differential thermal analysis, by starting measurement at room temperature.

3) Determine the second endothermic peak as the softening point.

The applied glaze slurry layer is baked simultaneously in the glass sealing step, to thereby form the glaze layer 2*d*.

The conductive glass powder has a preferable grain diameter (mean) in a range from ⅕ to ½ as large as a difference between the outer diameter d2 (of the front end section 13*d* of the terminal metal fitting 13) and the inner diameter D6 (of the second section 6*b* of the through hole 6 of the insulator 2). According to the embodiment of the present invention, the mean grain diameter of the conductive glass powder is 150 μm.

The conductive glass powder having the grain diameter (mean) less than ⅕ as large as the difference between the outer diameter d2 and the inner diameter D6 may be responsible for shortage of the pressure, resulting in decrease in the joint strength (between the insulator 2 and the terminal metal fitting 13).

On the contrary, the glass powder having the grain diameter (mean) more than ½ as large as the difference between the outer diameter d2 and the inner diameter D6 is less likely to flow an area between the outer diameter d2 and the inner diameter D6 in the glass sealing step. With this, the glass powder (more specifically, the second conductive glass seal layer 17) may find it difficult to adhere to entire part of the front end section 13*d* (and the front side of the small diameter section 13*c*).

The assembly formed after the glass sealing step as described above is then fitted with the metal shell 1, the ground electrode 4 and the like, to thereby complete the spark plug 100 as is seen in FIG. 1. The spark plug 100 is mounted to the engine block (not shown in FIG. 1) via the screw section 7, and thereby used as an ignition source of the mixture supplied to a combustion chamber of the engine.

EXAMPLE 1

The spark plug 100 shown in FIG. 1 was made in the following conditions:

At first, the insulator 2 (having dimensions listed in [Dimensions of insulator 2] above) for the spark plug 100 (M12) was made. Herein, the inner diameter D6 of the second section 6*b* of the through hole 6 is fixed at 3.9 mm. The above alloy steel SCM435 (herein, however, alloy steel SCM435 Cr—Mo) was used for making the terminal metal fittings 13 (see in FIG. 2) having various dimensions. More specifically, the inner diameter D6 (of the second section 6*b* of the through hole 6 of the insulator 2) was varied in dimensions provided that the inner diameter D6 should have a difference from the outer diameter d1 (of the small diameter section 13*c*) in a range from 0.9 mm to 1.5 mm. Herein, each of the knurled slots S formed in the front end section 13*d* has the predetermined angle θ1 of 20°. The thus prepared terminal metal fitting 13 was subjected to the glass sealing step as described above, for assembly to the insulator 2. The alloy steel SCM435 Cr—Mo is the one that can keep its Vickers hardness 150 Hv or over after the glass sealing step.

Moreover, for allowing the inner diameter D6 to have the various differences (in the range from 0.9 mm to 1.5 mm) from the outer diameter d1 with the dimension of the outer diameter d2 (of the front end section 13*d*) fixed, the following measure was taken in the example 1:

An area corresponding to the front end section 13*d* are differentiated in advance from an area corresponding to the small diameter section 13*c*. In addition, the outer diameter d2 has a fixed dimension of 3.4 mm.

Then, a visual inspection was carried out for checking for any cracks which may be caused to the insulator 2 in the glass sealing step. "Good" was awarded to those having no cracks. Productivity was evaluated based on the following criteria. Herein, seven evaluation Nos. were provided, each of which has a sample size of 200 (namely, the number of samples is 200), as is seen in Table 2 (to be described afterward).

<Criteria>

A: 99%≦"Good" ratio.

B: 90%≦"Good" ratio<99%.

C: 80%≦"Good" ratio<90%.

D: "Good" ratio<80%.

Each of the "Good" samples (no cracks found) of the insulator 2 was assembled with the metal shell 1, the ground electrode 4 and the like, to thereby obtain the spark plug 100 under the present invention, as is seen in FIG. 1. The thus obtained spark plug 100 was subjected to a load-life test specified by JIS-B8031 (1995) for testing durability and life time of the resistor 15 in the spark plug 100. In addition, another test pursuant to JIS-B8031 (1995) was carried out. Table 1 shows acceptance criteria of the JIS-B8031 (1995) and of the acceleration test pursuant to JIS-B8031 (1995).

TABLE 1

| | Acceptance criteria of load-life test | | |
|---|---|---|---|
| | JIS-B8031 (1995) | Increased resistance after JIS-B8031 (1995) | Acceleration test pursuant to JIS-B8031 (1995) |
| A | Acceptable | Not found | Acceptable |
| B | Acceptable | Not found | Not acceptable |
| C | Acceptable | Found | Not acceptable |
| D | Not acceptable | Not available | Not available |

Each of the above three tests can be summarized as below:

1) JIS-B8031 (1995):
   Checks resistance change after a test for 250 hr. at normal temperature.
2) Increased resistance after JIS-B8031 (1995):
   Checks for increased resistance after JIS-B8031 (1995).
   The resistance increased after JIS-B8031 (1995) is not preferable since it is likely to cause resistance change of 30% or over (not acceptable) in the continued test.
3) Acceleration test pursuant to JIS-B8031 (1995):
   Checks for resistance change after a stringent (accelerated) operating test {pursuant to JIS-B8031 (1995)} for 250 hr. at 350° C. Passing the stringent operating test is a proof of improved reliability.

Table 2 sums up results of the tests on productivity and load-life. In addition, Table 2 shows total determination based on the results of the tests on productivity and load-life.

TABLE 2

| | Difference: | Material (hardness after glass sealing | Determination | | |
|---|---|---|---|---|---|
| Evaluation No. | D6 − d1 (mm) | steps) (Hv) | Total | Productivity ("Good" ratio) | Load-life |
| 1-1 | 0.9 | 150< | D | D | A |
| 1-2 | 1.0 | 150< | B | B | A |
| 1-3 | 1.1 | 150< | A | A | A |
| 1-4 | 1.2 | 150< | B | A | B |
| 1-5 | 1.3 | 150< | B | A | B |
| 1-6 | 1.4 | 150< | B | A | B |
| 1-7 | 1.5 | 150< | D | A | D |

Table 2 can be interpreted as follows:

1) The difference between the inner diameter D6 (of the second section 6*b* of the through hole 6 of the insulator 2) and the outer diameter d1 (of the small diameter section 13*c*) in the range from 1.0 mm to 1.4 mm (Evaluation No. 1-2 to No. 1-6) for the spark plug 100 under the present invention can bring about good results for production (feasible).
2) The test samples of the evaluation No. 1-1 show many cracks in the glass sealing step. In other words, making the samples of the evaluation No. 1-1 may cause high yield loss, which is not preferable for mass production.
3) The test samples of the evaluation No. 1-7 do not meet the acceptance criterion of the load-life test, in other words, fail to show high reliability.

EXAMPLE 2

The spark plug 100 shown in FIG. 1 was made in the following conditions:

The difference between the inner diameter D6 (of the second section 6*b* of the through hole 6 of the insulator 2) and the outer diameter d1 (of the small diameter section 13*c* of the terminal metal fitting 13) was fixed at 1.1 mm. The outer diameter d2 (of the front end section 13*d*) was varied in a range from 3.0 mm to 3.7 mm. The insulator 2 used for the example 1 was also used for the example 2, with the difference between the inner diameter D6 and the outer diameter d2 in a range from 0.2 mm to 0.9 mm, as is seen in Table 3 (to be described afterward). The spark plug 100 was assembled in the same-manner as that of the example 1. Then, like the example 1, the tests on productivity and load-life were carried out according to the example 2. Table 3 sums up results of the tests according to the example 2.

Table 3 shows total determination based on the results of the tests on productivity and load-life.

TABLE 3

| | Difference: | Material (hardness after glass sealing | Determination | | |
|---|---|---|---|---|---|
| Evaluation No. | D6 − d2 (mm) | steps) (Hv) | Total | Productivity ("Good" ratio) | Load-life |
| 2-1 | 0.2 | 150< | C | C | A |
| 2-2 | 0.3 | 150< | B | B | A |
| 2-3 | 0.5 | 150< | A | A | A |
| 2-4 | 0.7 | 150< | B | A | B |
| 2-5 | 0.8 | 150< | B | A | B |
| 2-6 | 0.9 | 150< | C | A | C |

Table 3 can be interpreted as follows:

1) The difference between the inner diameter D6 (of the second section 6*b* of the through hole 6 of the insulator 2) and the outer diameter d2 (of the front end section 13*d*) in the range from 0.3 mm to 0.8 mm (Evaluation No. 2-2 to No. 2-5) for the spark plug 100 under the present invention can bring about good results for production (feasible).
2) The test samples of the evaluation No. 2-1 are likely to cause cracks in the glass sealing step. In other words, making the samples of the evaluation No. 2-1 may cause high yield loss, which is not preferable for mass production.
3) The test samples of the evaluation No. 2-6 do not meet the acceptance criterion of the load-life test in the acceleration test, in other words, fail to show high reliability.

EXAMPLE 3

The spark plug 100 shown in FIG. 1 was made in the following conditions:

The outer diameter d1 (mean) of the small diameter section 13*c* of the terminal metal fitting 13 is fixed at 2.8 mm. The outer diameter d2 of the front end section 13*d* is fixed at 3.4 mm. The predetermined angle θ1 defined between the knurled slot S (to be formed in the front end section 13*d*) and the reference line H is 20° and 45°. The insulator 2 used for the example 1 was also used for the example 3. The spark plug 100 was assembled in the same manner as that of the example 1. Then, like the example 1, the tests on productivity and load-life were carried out according to the example 3. Table 4 sums up results of the tests according to the example 3.

Table 4 shows the total determination only.

TABLE 4

| Evaluation No. | Predetermined angle θ1: (°) | Difference: D6 − d1 (mm) | Difference: D6 − d2 (mm) | Material (hardness after glass sealing steps) (Hv) | Determination |
|---|---|---|---|---|---|
| 3-1 | 20 | 1.1 | 0.5 | 150< | A |
| 3-2 | 45 | 1.1 | 0.5 | 150< | B |

Table 4 can be interpreted as follows:

1) The predetermined angles θ1=20° and θ1=45° can bring about good results, although the former is more preferable than the latter.
2) The determination A is better than the determination B for industrial production, which is true for the example 1 and the example 2. In other words, the determination A is a proof of excellent performance.

According to the embodiment of the present invention, the terminal section 13*a* (of the terminal metal fitting 13) having the Vickers hardness of 150 Hv or over contributes to prevention of wear. Moreover, the embodiment of the present invention can provide the small spark plug 100 (M12) having the insulator 2, the terminal metal fitting 13 and the center electrode 3 which are joined together securely.

The embodiment of the present invention is most preferable to the spark plug having the screw diameter of 12 mm (M12), but also applicable to the smaller screw diameter of 10 mm (M10) and the like.

Although the present invention has been described above by reference to certain embodiments, the present invention is not limited to the embodiments described above. Modifications and variations of the embodiments described above will occur to those skilled in the art, in light of the above teachings.

The entire contents of basic Japanese Patent Application No. P2001-335110 (filed on Oct. 31, 2001 in Japan) from which priority is claimed is incorporated herein by reference, in order to take some protection against mistranslation or omitted portions.

The scope of the present invention is defined with reference to the following claims.

What is claimed is:

1. A spark plug, comprising:

a metal shell defining a front side having an outer periphery formed with a screw section which has a nominal size smaller than or equal to M12;

a center electrode;

a conductive seal layer;

a terminal metal fitting fixed to the center electrode by way of the conductive seal layer, the terminal metal fitting having a Vickers hardness in a range from 150 Hv to 300 Hv, the terminal metal fitting including:

a front end section having an outer diameter, and embedded in the conductive seal layer, and a small diameter section disposed on a rear side of the front end section and having an outer diameter which is smaller than the outer diameter of the front end section; and an insulator formed with a through hole which extends in a direction of an axial line of the insulator and houses the center electrode, the conductive seal layer and the terminal metal fitting, the insulator having an outer periphery where the metal shell is disposed, the insulator defining the following sides in the direction of the axial line of the insulator:

i) a front side where the center electrode is disposed, and ii) a rear side where the terminal metal fitting is disposed, the through hole having an inner diameter which is different from the outer diameter of the small diameter section of the terminal metal fitting in a range from 1.0 mm to 1.4 mm.

2. The spark plug as claimed in claim 1, wherein the inner diameter of the through hole of the insulator is different from the outer diameter of the front end section of the terminal metal fitting in a range from 0.3 mm to 0.8 mm.

3. The spark plug as claimed in claim 2, wherein the inner diameter of the through hole of the insulator is larger than the outer diameter of the small diameter section of the terminal metal fitting in the range from 1.0 mm to 1.4 mm, and the inner diameter of the through hole of the insulator is larger than the outer diameter of the front end section of the terminal metal fitting in the range from 0.3 mm to 0.8 mm.

4. The spark plug as claimed in claim 1, wherein the front end section of the terminal metal fitting has an outer periphery which is knurled.

5. The spark plug as claimed in claim 4, wherein knurling the outer periphery of the front end section of the terminal metal fitting forms a plurality of knurled slots which are parallel with each other, and an angle is so adjusted to vary in a range from 15° to 25° between one of the knurled slots and a reference line perpendicular to the axial line of the insulator.

6. The spark plug as claimed in claim 1, wherein the through hole of the insulator has a first section and a second section, the first section into which the center electrode is inserted is shaped substantially into a cylinder, the second section which is also shaped substantially into a cylinder is disposed on a rear side of the first section, and is larger in diameter than the first section, and the terminal metal fitting and a resistor are housed in the second section.

7. The spark plug as claimed in claim 1, wherein the terminal metal fitting further includes a terminal section which is disposed at a rearmost position of the terminal metal fitting in such a manner as to protrude rearward from the insulator, and the Vickers hardness in the range from 150 Hv to 300 Hv is measured in the terminal section.

8. The spark plug as claimed in claim 1, wherein the screw section of the metal shell has the nominal size of M10.

9. The spark plug as claimed in claim 1, wherein the front end section of the terminal metal fitting has an outer periphery which is machined by a surface roughing.

10. A spark plug, comprising:

a metal shell;

a center electrode;

a conductive seal layer;

a terminal metal fitting fixed to the center electrode by way of the conductive seal layer, the terminal metal fitting including:

a front end section having an outer diameter, and embedded in the conductive seal layer, and a small diameter section disposed on a rear side of the front end section and having an outer diameter which is smaller than the outer diameter of the front end section in a range from 0.3 mm to 0.7 mm, the small diameter section defining a front side which is partly embedded in the conductive seal layer; and an insulator formed with a through hole which extends in a direction of an axial line of the insulator and houses the center electrode, the conductive seal layer and the terminal metal fitting, the insulator having an outer periphery where the metal shell is disposed, the insulator defining the following sides in the direction of the axial line of the insulator:

i) a front side where the center electrode is disposed, and ii) a rear side where the terminal metal fitting is disposed.

11. The spark plug as claimed in claim 10, wherein the conductive seal layer is made of a conductive glass powder having a mean diameter ⅕ to ½ as large as a difference between an inner diameter of the through hole and the outer diameter of the front end section of the terminal metal fitting.

12. The spark plug as claimed in claim 10, wherein the front end section of the terminal metal fitting has an outer periphery which is knurled.

13. The spark plug as claimed in claim 12, wherein the conductive seal layer is made of a conductive glass powder having a mean diameter ⅙ to ⅓ as large as a distance between two of knurled slots formed through the knurling which is carried out on the outer periphery of the front end section of the terminal metal fitting.

14. The spark plug as claimed in claim 12, wherein knurling the outer periphery of the front end section of the terminal metal fitting forms a plurality of knurled slots which are parallel with each other, and an angle is so adjusted to vary in a range from 15° to 25° between one of the knurled slots and a reference line perpendicular to the axial line of the insulator.

15. The spark plug as claimed in claim 10, wherein the terminal metal fitting has a Vickers hardness in a range from 150 Hv to 300 Hv.

16. The spark plug as claimed in claim 10, wherein the through hole of the insulator has an inner diameter which is different from the outer diameter of the small diameter section in a range from 1.0 mm to 1.4 mm.

17. The spark plug as claimed in claim 11, wherein the inner diameter of the through hole of the insulator is different from the outer diameter of the front end section of the terminal metal fitting in a range from 0.3 mm to 0.8 mm.

18. The spark plug as claimed in claim 17, wherein the inner diameter of the through hole of the insulator is larger than the outer diameter of the small diameter section of the terminal metal fitting in the range from 1.0 mm to 1.4 mm, and the inner diameter of the through hole of the insulator is larger than the outer diameter of the front end section of the terminal metal fitting in the range from 0.3 mm to 0.8 mm.

19. The spark plug as claimed in claim 15, wherein the terminal metal fitting further includes a terminal section which is disposed at a rearmost position of the terminal metal fitting in such a manner as to protrude rearward from the insulator, and the Vickers hardness in the range from 150 Hv to 300 Hv is measured in the terminal section.

20. The spark plug as claimed in claim 10, wherein the front end section of the terminal metal fitting has an outer periphery which is machined by a surface roughing.

* * * * *